US006167921B1

(12) United States Patent
Busick et al.

(10) Patent No.: US 6,167,921 B1
(45) Date of Patent: Jan. 2, 2001

(54) MOUNTING ADAPTER AND RELATED BOTTLE CAP FOR A BOTTLED WATER COOLER

(75) Inventors: Louis M. Busick, Columbus; David B. Chaney, Westerville; Kenneth J. Hydak, Worthington, all of OH (US)

(73) Assignee: Oasis Corporation, Columbus, OH (US)

( * ) Notice: Under 35 U.S.C. 154(b), the term of this patent shall be extended for 0 days.

(21) Appl. No.: 09/406,210

(22) Filed: Sep. 24, 1999

Related U.S. Application Data

(60) Provisional application No. 60/102,603, filed on Oct. 1, 1998.

(51) Int. Cl.[7] ..... B65B 3/04

(52) U.S. Cl. ..... 141/18; 141/353; 141/364

(58) Field of Search ..... 141/18, 21, 319, 141/328, 330, 351, 353, 354, 355, 360, 363, 364, 365, 366, 383, 385, 386; 222/69, 83.5, 185.1, 189.09

(56) References Cited

U.S. PATENT DOCUMENTS 5,031,676 * 7/1991 Ulm ..... 141/346
5,222,531 * 6/1993 Baker et al. ..... 141/18
5,273,083 * 12/1993 Burrows ..... 141/18
5,289,855 * 3/1994 Baker et al. ..... 141/18
5,337,922 * 8/1994 Salkeld et al. ..... 222/129
5,526,961 * 6/1996 Burrows ..... 222/185.1
5,647,416 * 7/1997 Desrosiers et al. ..... 141/351
5,653,270 * 8/1997 Burrows ..... 141/18
6,029,860 * 2/2000 Donselman et al. ..... 222/185.1

* cited by examiner

*Primary Examiner*—Henry J. Recla
*Assistant Examiner*—Peter DeVore
(74) *Attorney, Agent, or Firm*—Kelly Bauersfeld Lowry & Kelley, LLP

(57) ABSTRACT

A mounting adapter and related bottle cap are provided for use in a bottled water cooler having an upwardly open reservoir for receiving a supply of water from a bottle mounted over the reservoir in an inverted orientation to permit water downflow from the bottle to the reservoir. The mounting adapter comprises a compact housing for press-fit installation into an upper region of the reservoir, wherein the adapter housing carries an outer seal ring for sealing engagement with an inner wall surface of the reservoir. An upstanding feed tube or probe carried by the adapter housing includes separate air and water flow passages as described in U.S. Pat. No. 5,413,152, and has an upper tip end shaped for opening and closing a valved bottle cap mounted on the neck of a water-containing bottle supported in an inverted position over the reservoir. The bottle cap may be constructed, e.g., according to U.S. Pat. No. 5,232,125, with an outer skirt adapted for reusable snap-fit mounting onto and removal from the necks of successive water bottles mounted on the cooler. The adapter housing includes handle ports formed in an upper segment thereof for facilitated mounting of the adapter into and removal from a cooler reservoir. In addition, a lower end of the dual flow path feed tube includes a radially outwardly extending baffle disk to assist in isolating the separated air and water flows during air-water exchange between the cooler reservoir and the overlying inverted water bottle.

35 Claims, 12 Drawing Sheets

MOUNTING ADAPTER AND RELATED BOTTLE CAP FOR A BOTTLED WATER COOLER

This application claims benefit to provisional application Ser. No. 60/102,603 filling date Oct. 1, 1998.

BACKGROUND OF THE INVENTION

This invention relates generally to improvements in mounting adapters of the type for mounting onto a bottled water cooler and including a feed tube or probe for operating a normally closed bottle cap carried on the neck of a water-containing bottle, to open the bottle cap incident to mounting of the bottle in an inverted orientation onto the water cooler to permit water flow downwardly from the bottle into a cooler reservoir. More particularly, this invention is related to an improved mounting adapter constructed from a relative minimum number of component parts, and wherein the adapter is designed for fast and simple installation into and/or removal from the reservoir of a water cooler, and further wherein the feed tube is designed for an improved water flow rate from the bottle to the reservoir Bottled water coolers are generally known in the art, to comprise a cooler housing supporting an upwardly open reservoir to receive a supply of water for on-demand dispensing via one or more faucet valves or the like. The cooler housing and/or the reservoir are designed to support a water bottle of typically three to five gallon capacity in an inverted orientation over the reservoir, so that water contained within the bottle may flow downwardly into and fill the reservoir to a level sufficient to cover an open bottle mouth formed in a bottle neck. In this regard, downward water flow from the bottle is accompanied by an upward exchange of air passing from the reservoir into the bottle to replace the volume of water displaced or discharged from the bottle. This air-water exchange between the overlying bottle and the underlying reservoir continues until the reservoir water level rises sufficiently to cover the bottle mouth, at which time upward air exchange is halted to correspondingly stop downward waterflow. Subsequent dispensing of water from the reservoir by operation of the faucet valves causes the water level within the reservoir to fall below and thus uncover the bottle mouth, whereupon the air-water exchange may resume to enable additional water to flow downwardly from the bottle to refill the reservoir. In many modern bottled water coolers of this general type, the reservoir may be associated with refrigeration means for chilling at least a portion of the water contained therein to provide chilled water used primarily for drinking or for use in making chilled beverages.

In the past, it has been conventional to provide the water bottle to a customer in a substantially filled state with the bottle mouth closed and sealed by a bottle cap. This bottle cap normally includes a tear-away skirt to allow the customer to remove the cap immediately prior to installation of the bottle in an inverted orientation on the cooler. More recently, alternative bottle caps have been designed to remain on the water bottle when the bottle is installed onto the cooler, wherein such alternative bottle caps are designed to be engaged and opened by a feed tube or probe mounted on the cooler in a position over the reservoir. See, for example, U.S. Pat. Nos. 4,874,023; 5,222,531; 5,232,125 and 5,413,152. In these arrangements, the feed tube or probe is provided as a portion of a mounting adapter installed onto the cooler to extend over and substantially close the top of the reservoir to reduce or prevent entry of dirt and other contaminants. A seal ring of the like is normally provided on the adapter to sealingly engage the reservoir, and an air entry flow path to the reservoir interior is equipped with a filter element to limit air ingress to clean filtered air. The feed tube or probe has a contoured tip for engaging a valve plug on the bottle cap to open a flow path as an incident to bottle installation, thereby permitting water downflow from the bottle into the reservoir together with accompanying air exchange upwardly from the reservoir into the interior of the water bottle. The feed tube or probe is further designed to return the valve plug to a closed position when the bottle is removed from the cooler. U.S. Pat. No. 5,413,152 provides a particularly beneficial feed tube geometry wherein separate or dual flow paths are formed for separate exchange of air flowing upwardly from the reservoir into the bottle interior, and water flowing downwardly from the bottle interior into the reservoir.

SUMMARY OF THE INVENTION

In accordance with the invention, an improved mounting adapter and related bottle cap are provided for use in a bottled water cooler. The mounting adapter comprises a compact adapter housing having a size and shape for slide-fit reception into the upper end of an upwardly open cooler reservoir, wherein the adapter housing carries a seal ring for relatively tight and slide-fit sealed engagement with an inner wall surface of the reservoir. The adapter housing includes easily grasped handle means for facilitated slide-in installation into and, if desired, subsequent slide-out removal from the cooler reservoir. The adapter housing additionally supports an upstanding feed tube or probe for operatively engaging a valved bottle cap mounted on the neck of a water-containing bottle supported in an inverted orientation over the cooler reservoir. In the preferred form, the feed tube or probe defines dual or separate flow passages for air and water as described in U.S. Pat. No. 5,413,152, and further includes a radially outwardly extending baffle disk at a lower end thereof for improved separation of air and water flows during air-water exchange between the overlying inverted water bottle and the cooler reservoir.

In the preferred form of the invention, the compact adapter housing is constructed from molded plastic or the like as a unitary or substantially unitary component to include an upper cylindrical sleeve segment defining a recessed outer annular channel for receiving and supporting the seal ring. In one form, an upper margin of the sleeve segment defines an outwardly radiating upper rim for seating onto a matingly shaped support ledge formed at the upper end of the cooler reservoir. In another form, an upper margin of the sleeve segment carries a plurality of support clips for engaging an upper end of the cooler reservoir to support the adapter housing therein. In either embodiment, the handle means such as radially outwardly open handle ports are formed in the upper sleeve segment at a location above the seal ring, wherein these handle ports provide a structure for easy manual grasping and manipulation of the adapter housing in the course of slide-fit installation into the cooler reservoir.

The upper sleeve segment of the mounting adapter has a lower margin merging with a radially inwardly extending annular support landing, which is joined in turn at an inner margin thereof with a suspended central cup or well having a bottom wall. The feed tube projects upwardly from this bottom wall and terminates at an upper tip end disposed at or a short distance above the support landing. An inner tube is mounted within the feed tube and cooperates therewith to define separate flow passages for air and water, as shown and described in U.S. Pat. No. 5,413,152, which is incorporated by reference herein. The baffle disk comprises a radially outwardly extending flange at a lower end of the inner tube, which terminates a short distance below the bottom wall of the central well. This baffle disk assists in separating the air and water flows to result in an improved water flow rate from the overlying bottle to the underlying reservoir.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
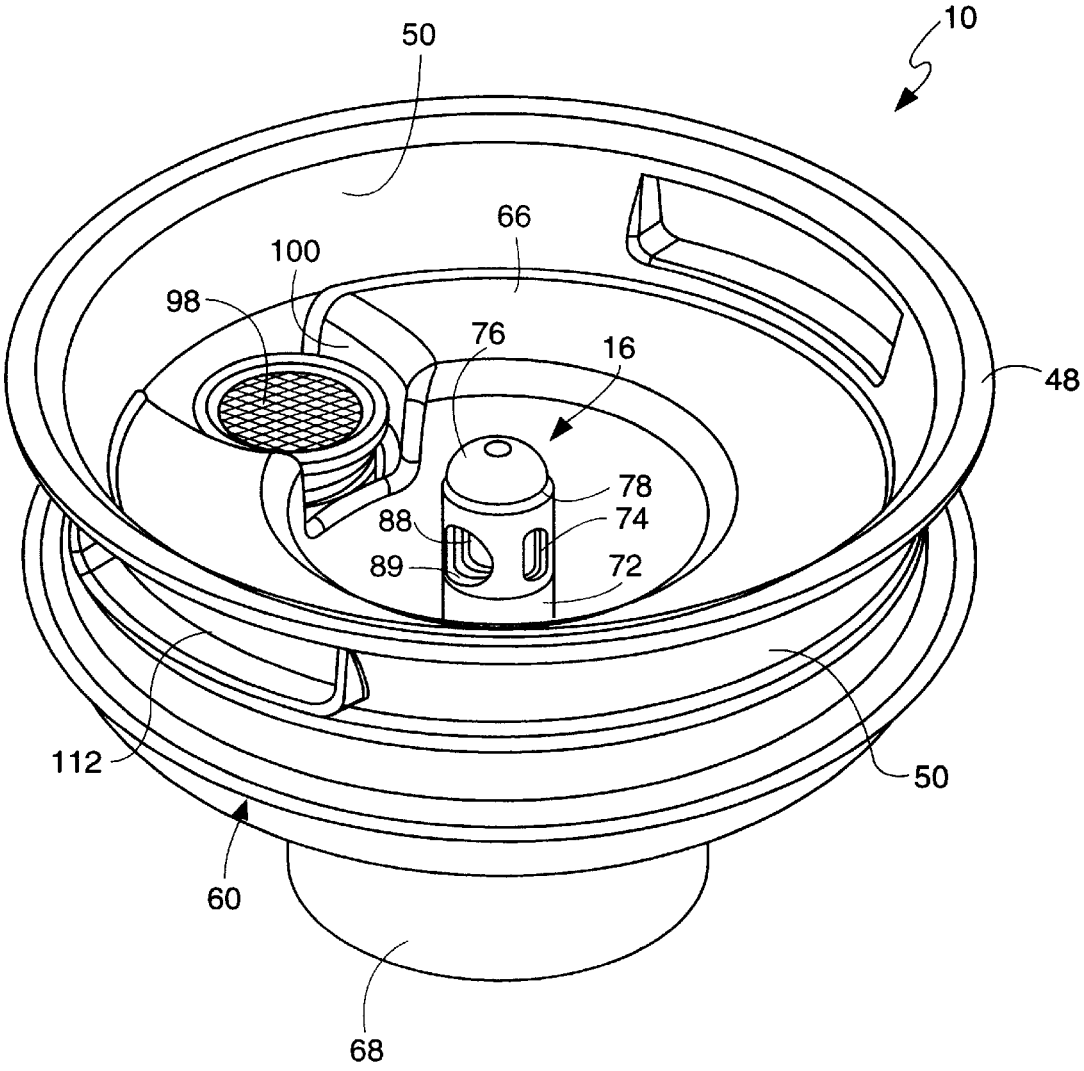
FIG. 1 is a top perspective view illustrating an improved mounting adapter constructed in accordance with one preferred form of the invention.
Figure 2:
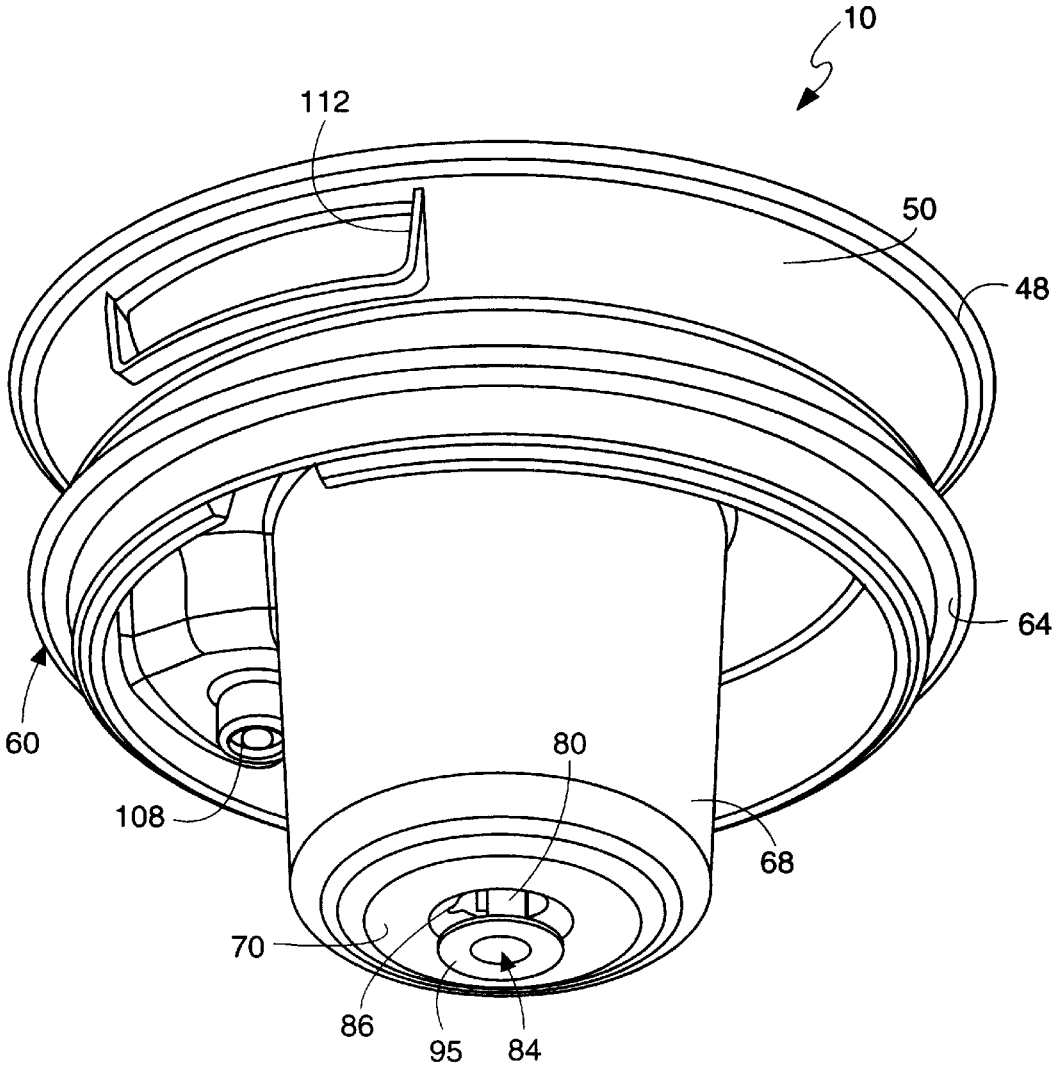
FIG. 2 is a bottom perspective view of the mounting adapter shown in FIG. 1.

As shown in the exemplary drawings, an improved mounting adapter referred to generally by the reference numeral 10 is provided for quick and easy press-fit installation into the reservoir 12 of a bottled water cooler 14. As shown best in FIG. 3, the mounting adapter 10 includes a dual flow path feed tube or probe 16 for engaging a bottle cap 18 mounted on the neck 20 of a water-containing bottle 22 for opening the cap 18 when the bottle is installed on the cooler 14, and for closing the cap 18 when the bottle 22 is lifted and removed from the cooler. The improved adapter 10 of the present invention is designed for quick and easy slide-fit installation into the cooler reservoir 12 and, if subsequently desired, quick and easy slide-out removal from the cooler reservoir. In addition, the adapter 10 incorporates an improved feed tube configuration for achieving faster water flow from the bottle 22 to the cooler reservoir 12.

Figure 3:
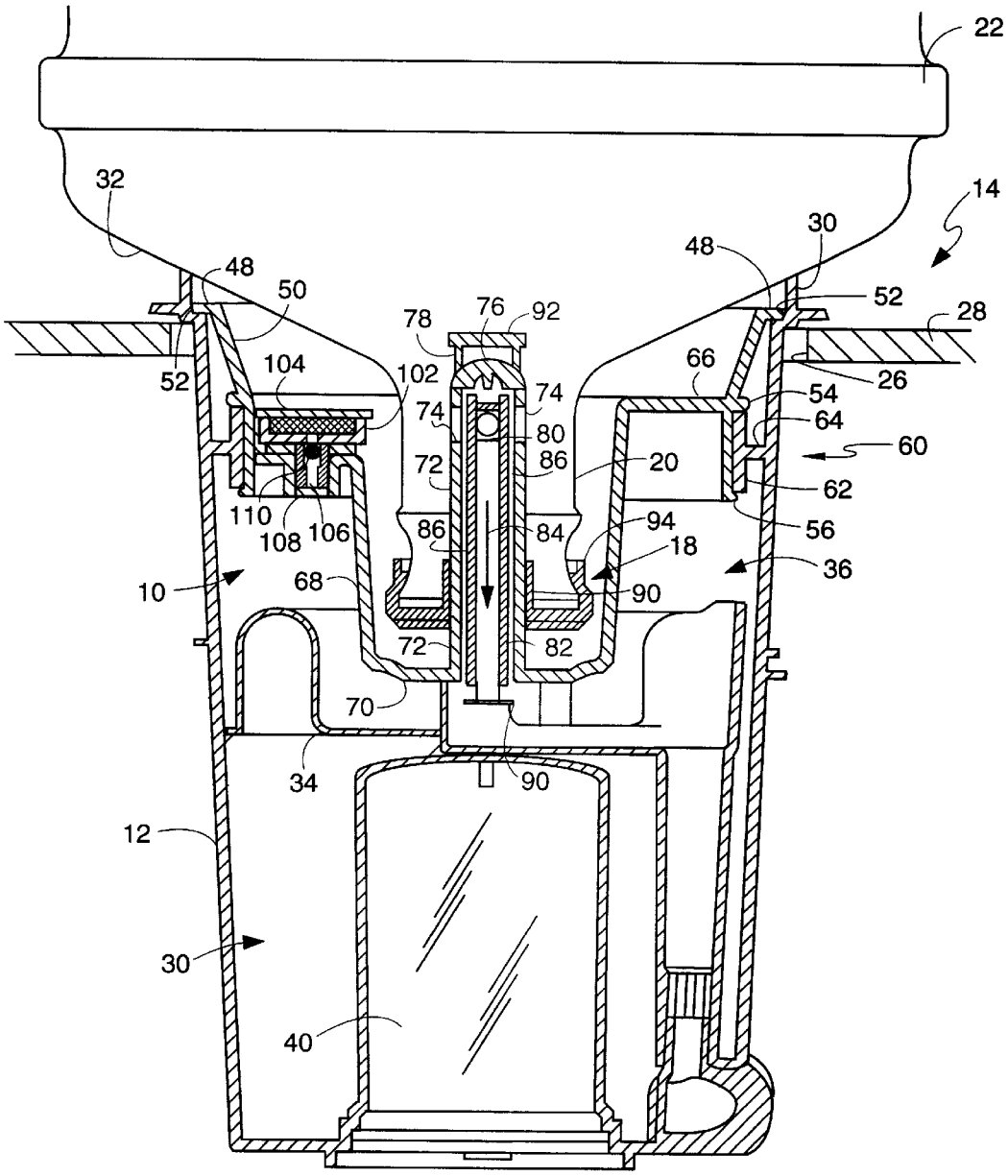
FIG. 3 is a fragmented vertical sectional view depicting the mounting adapter of FIG. 1 installed into the reservoir of a bottled water cooler, with a water bottle mounted on the cooler in an inverted orientation.
Figure 4:
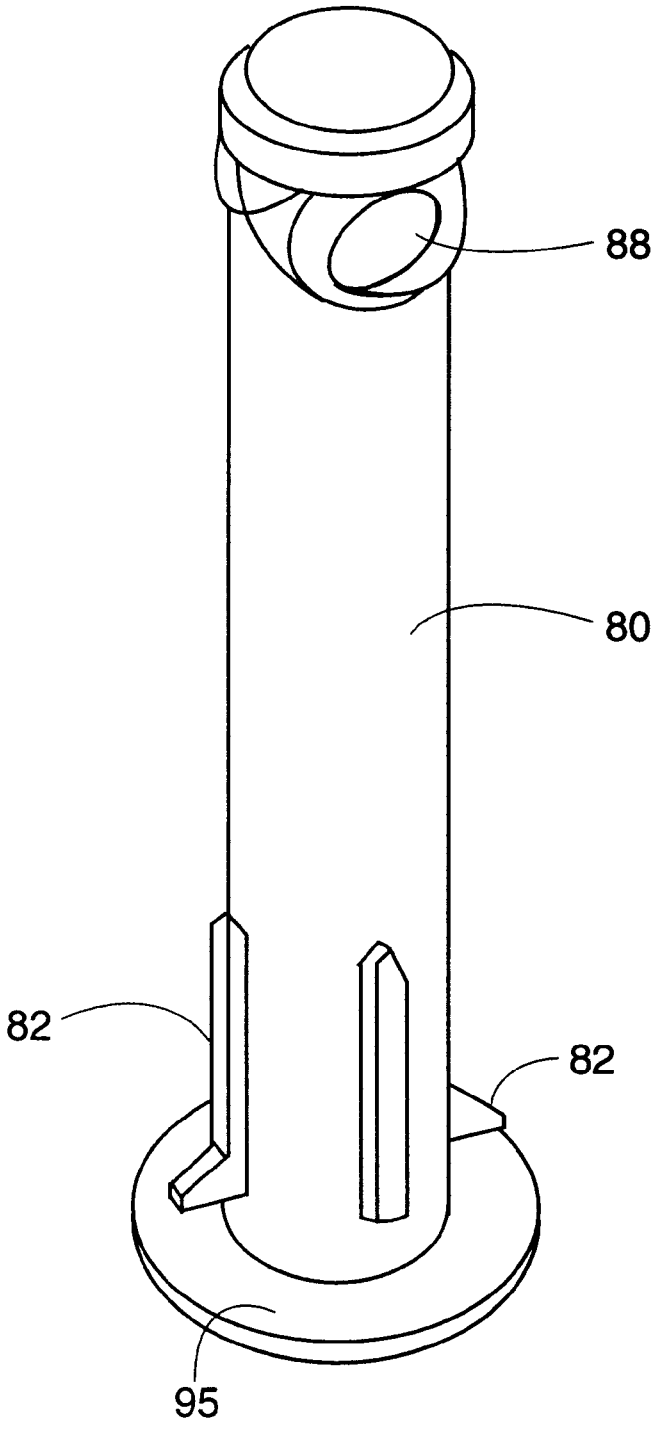
FIG. 4 is a perspective view of an inner flow tube forming a portion of a dual flow path feed tube as shown in FIGS. 1 and 3.
Figure 6:
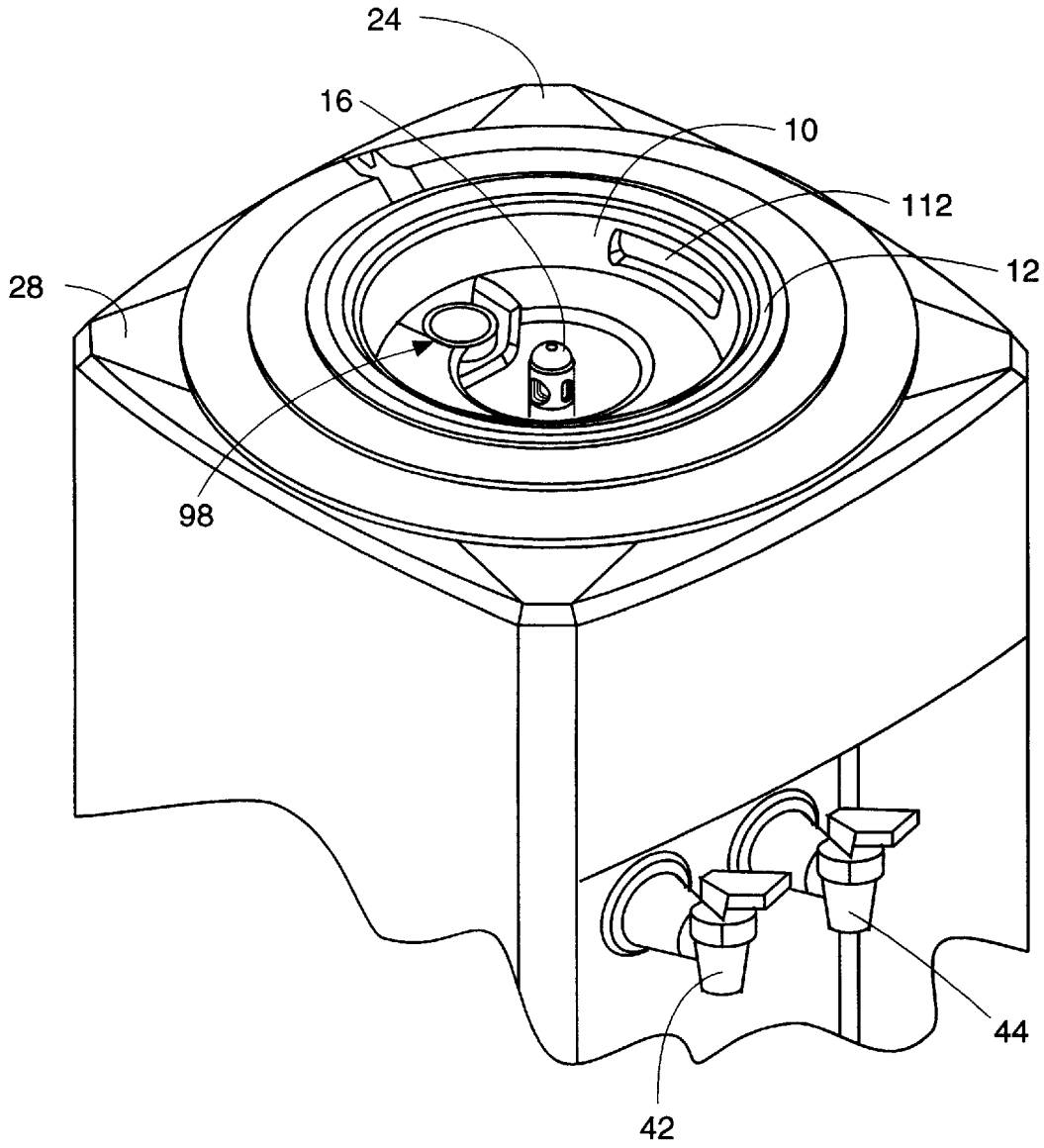
FIG. 6 is a top perspective view illustrating the mounting adapter of FIG. 1 installed onto a bottled water cooler.

The mounting adapter 10 and the related bottle cap 18 of the present invention are provided for use in a bottled water cooler 14 of the type having an upwardly open reservoir 12 for receiving and storing a supply of water for ready dispensing upon operation of one or more faucet valves or the like. In this regard, the water cooler 14 typically comprises a cooler cabinet or housing 24 (FIG. 6) with the reservoir 12 mounted within an upper region thereof (FIG. 3). The reservoir 12 defines an open upper end exposed upwardly through a central opening 26 in a housing top or lid 28. FIG. 3 shows a reservoir 12 of the type having an upwardly projecting upper margin or rim 30 disposed vertically above an upper surface of the top 28 to define an annular support rim for engaging and supporting the sloping shoulder portion 32 of a typical water-containing bottle 22. This annular rim 30 supports the bottle 22 in an inverted orientation with the open-mouthed neck 20 thereof disposed within an upper region of the reservoir 12 for dispensing water from the bottle into the reservoir, as will be described in more detail. As shown in FIG. 3, the reservoir interior may be subdivided by a baffle plate 34 into an upper region 36 for containing water substantially at room temperature, and a lower region 38 for containing chilled water in thermal association with a chiller probe 40. Separate faucets 42 and 44 (FIG. 6) are provided for separate dispensing of water from these two regions 36 and 38, all in a manner known to persons skilled in the art. In this regard, the general construction and operation of the illustrative water cooler 14 is described in more detail in U.S. Pat. Nos. 5,246,141; 5,307,958; 5,289,951; 5,395,014; and 5,297,700 which are incorporated by reference herein.

The mounting adapter 10 is shown in one preferred form in FIGS. 1–5 to comprise a substantially one-piece adapter housing or body of lightweight molded plastic or the like. More particularly, this adapter body includes an upper mounting flange 48 extending radially outwardly a short distance from a generally cylindrical upper sleeve-shaped segment 50, wherein the flange 48 is sized to rest upon a radially inwardly extending ledge 52 near the upper rim 30 of the reservoir 12. The upper sleeve segment 50 extends from the flange 48 in a downward direction within the reservoir, and includes a vertically spaced pair of radially outwardly protruding rings 54 and 56 (FIG. 3) which cooperatively define a radially outwardly open annular channel 58 for receiving and supporting a seal ring 60 of suitable resilient elastomeric material. As shown in FIG. 3, the seal ring 60 may include a base 62 secured with an interference fit into the channel 58, and a radially outwardly protruding annular seal lip 64 for slidably and sealingly engaging an interior wall surface of the reservoir 12.

Figure 5:
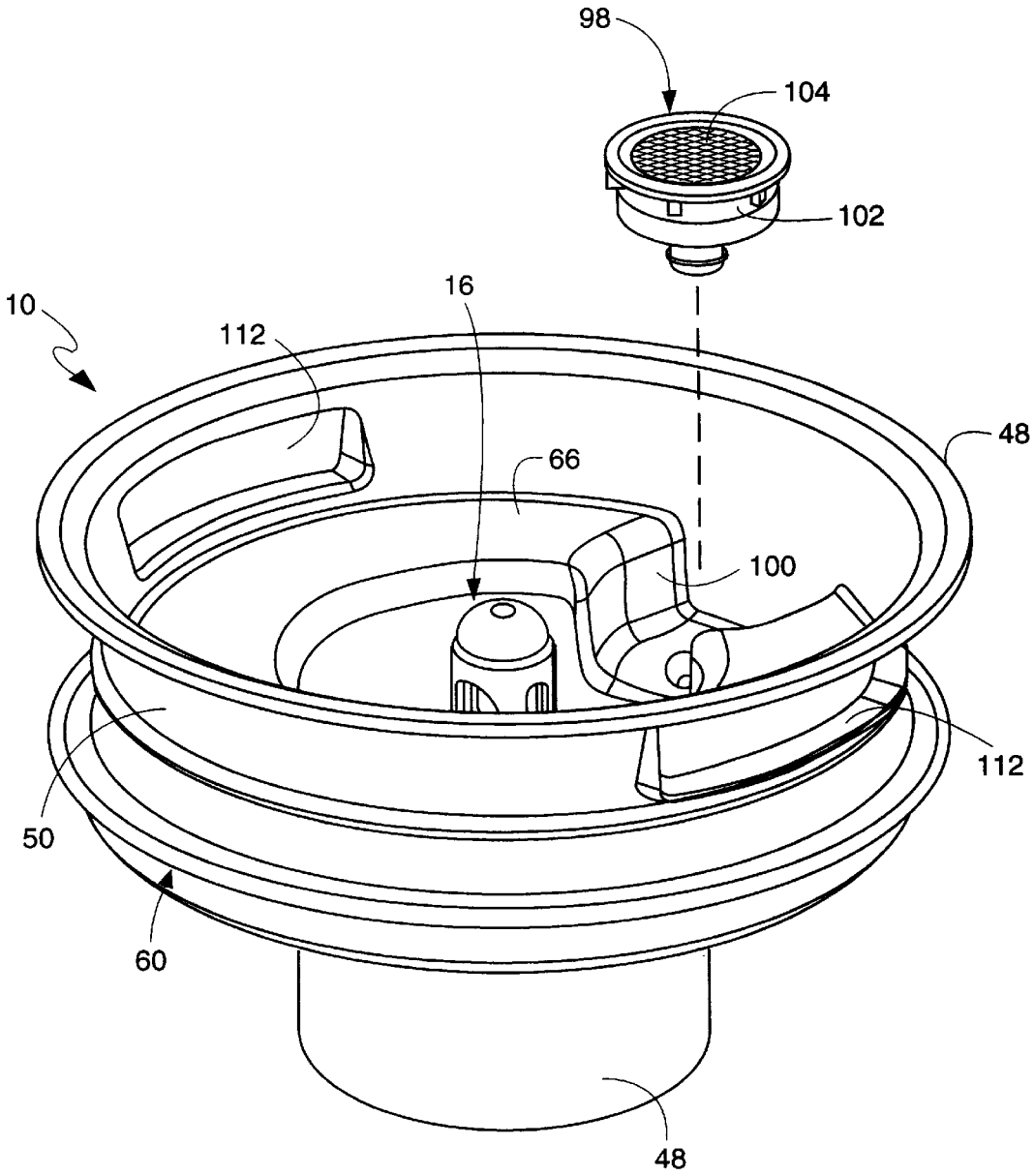
FIG. 5 is an exploded top perspective of the mounting adapter shown in FIG. 1.

The upper sleeve segment 50 of the adapter 10 is joined to a radially inwardly extending and substantially horizontally oriented support landing 66 (FIGS. 1, 3 and 5). This landing 66 is joined in turn at a radially inner margin thereof with an upper margin of a central cup or well 68 which is thus suspended therefrom. The well 68 includes a bottom wall 70 (FIGS. 2 and 3) which is joined to an upstanding and centrally positioned outer tube 72 (FIGS. 1 and 3) forming a portion of the dual flow path feed tube or probe 16. A pair of laterally open flow slots 74 are formed in this outer tube 72 near the upper end thereof, immediately beneath a dome-shaped tube tip 76 defining a shallow undercut recess 78. The upper end of the outer tube 72 terminates a short distance above the landing 66. Moreover, an inner tube 80 (also shown in FIG. 4) is press-fitted or otherwise suitably mounted into the outer tube 72, with appropriate spacers 82 positioning the inner tube in concentric spaced relation within the outer tube 72 to define a central water flow path 84 (FIG. 3) and an annular air flow path 86. Flow ports 88 formed in the inner tube 80 near the upper end thereof are aligned with flow ports 89 in the outer tube 72 (FIGS. 1 and 3) to permit water flow into the upper end of the central water flow path 84, whereas the flow slots 74 permit air passage from the air path 86 back into the bottle interior. A lower end of the inner tube 80, defining the water flow path 84, terminates a short distance below the bottom wall 70 of the well 68.

Figure 8:
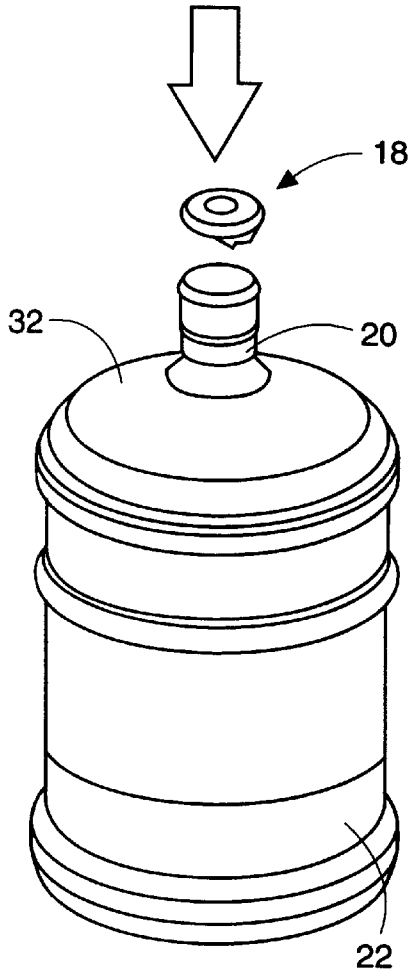
FIG. 8 is a perspective view showing the water bottle of FIG. 7 with the conventional cap removed therefrom, and further depicting the water bottle in exploded relation with a valved bottle cap formed in accordance with the invention.
Figure 9:
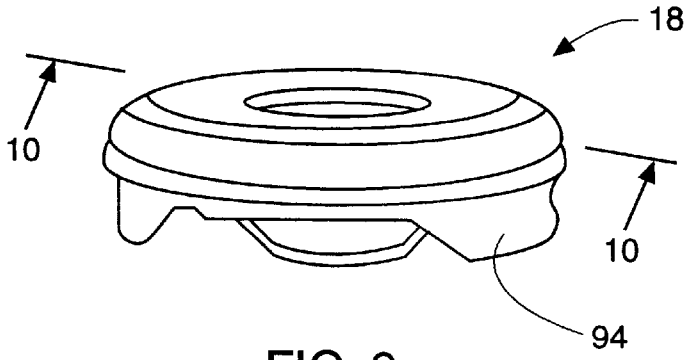
FIG. 9 is an enlarged perspective view of the valved bottle cap of FIG. 8.
Figure 10:
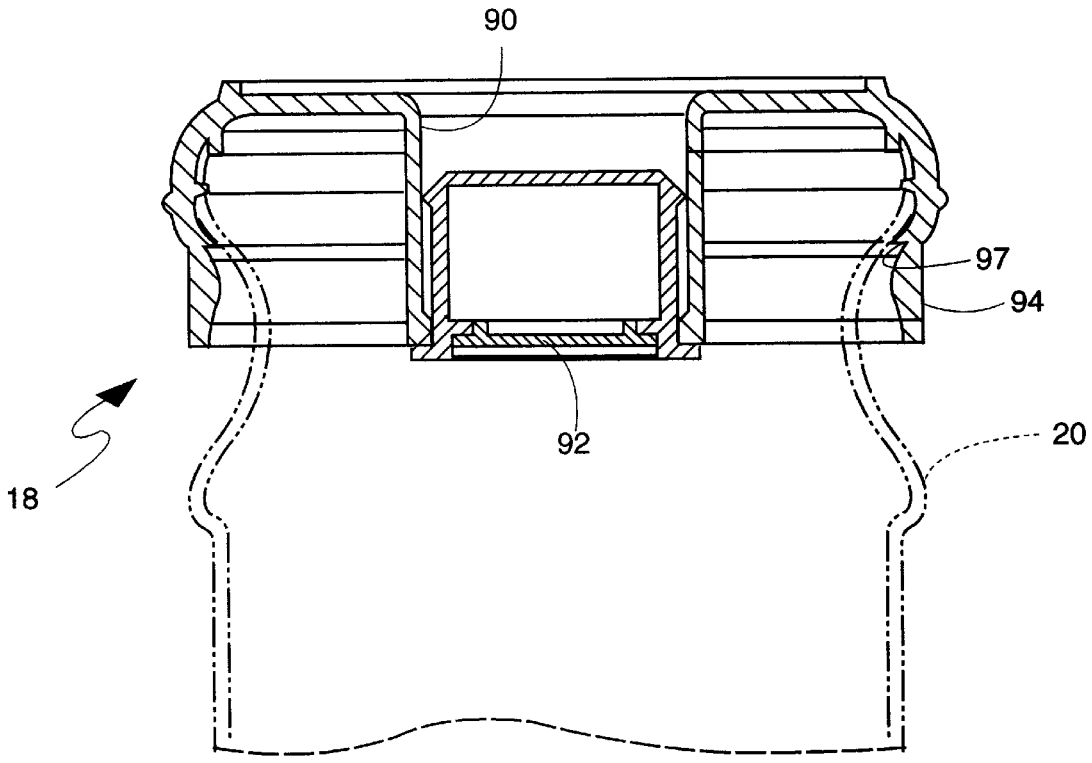
FIG. 10 is a vertical sectional view taken generally on the line 10—10 of FIG. 9, and showing mounting of the valved bottle cap onto a water bottle depicted in dotted lines.
Figure 11:
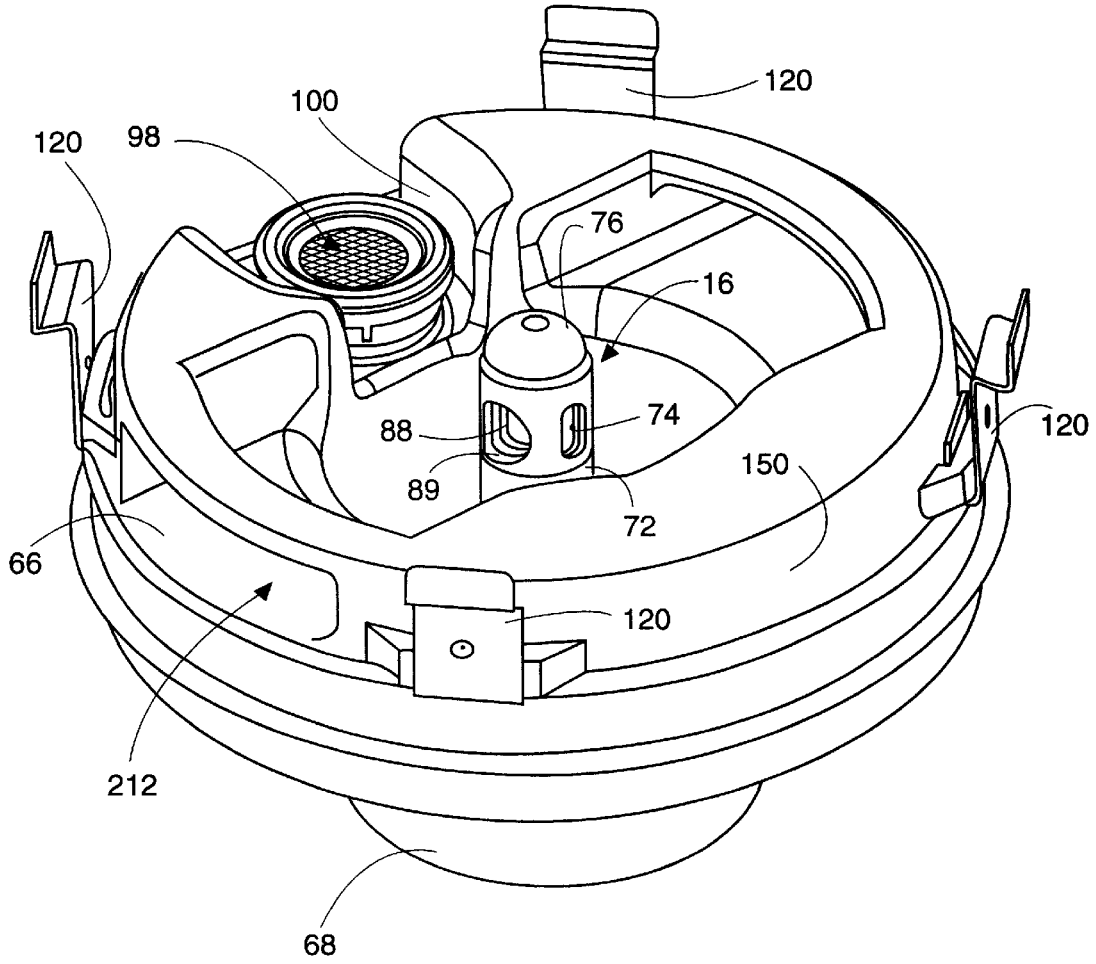
FIG. 11 is a top perspective view of an alternative preferred embodiment of the improved mounting adapter of the present invention.
Figure 12:
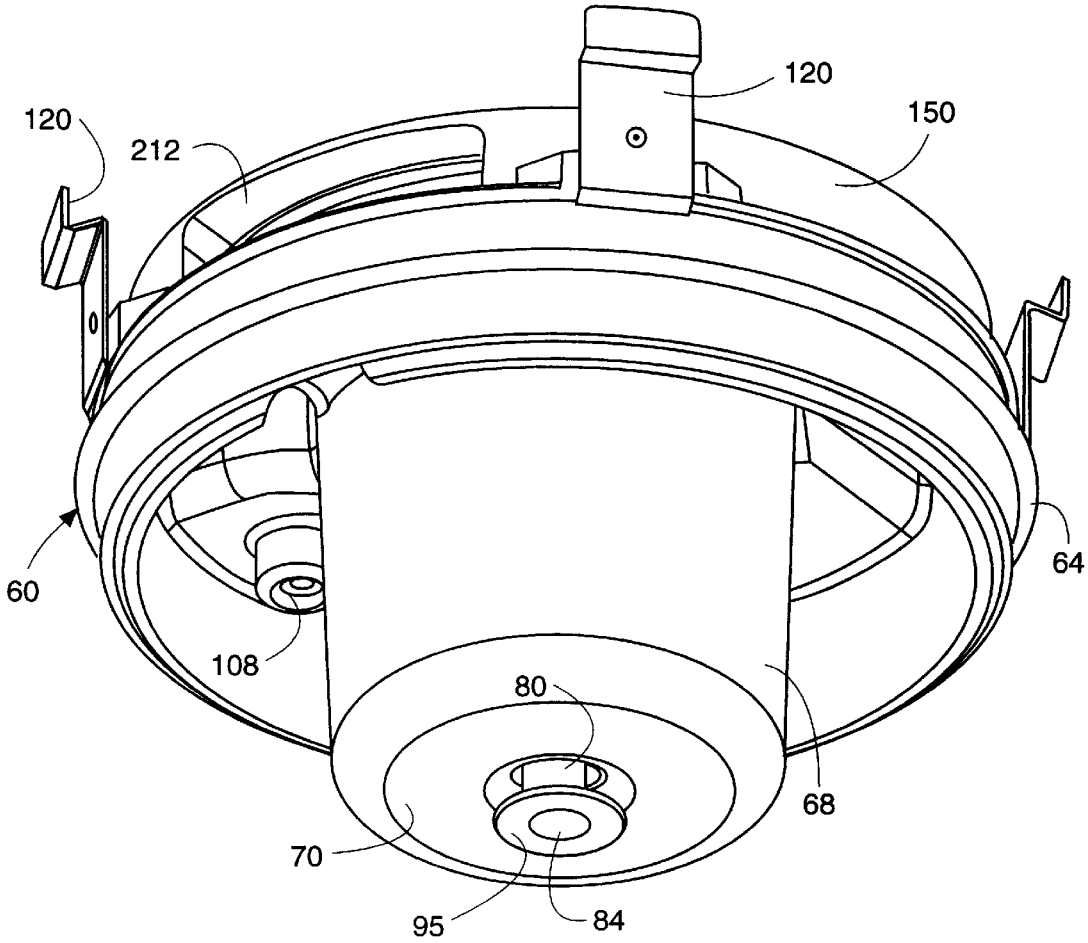
FIG. 12, is a bottom perspective view of the mounting adapter of FIG. 11.

The overall construction and operation of the dual flow path feed tube or probe 16, as described, conforms generally with the feed tube shown and described in U.S. Pat. No. 5,413,152, which is incorporated by reference herein. That is, the feed tube 16 is designed to engage and operate a valved bottle cap 18 of a type having a central sleeve 90 (FIGS. 8–10) defining a flow passage therein which is normally closed by a movable valve plug 92. The cap 18 is left on the bottle neck 20 during bottle mounting onto the water cooler 14. The landing 66 provides a convenient temporary support site to rest and support the typically heavy filled water bottle as the bottle is maneuvered to fit the feed tube 16 into the central cap sleeve 90. The bottle 22 is then positioned with its sloping shoulder portion 32 on the reservoir rim 30, and with the feed tube 16 extending into the cap sleeve 90 to engage and open the valve plug 92. Importantly, the tip 76 of the feed tube 16 engages and retains the valve plug 92 in a position to draw the valve plug 92 back to a closed position when the bottle is subsequently removed from the cooler. As viewed in FIG. 3, with the bottle 22 fully installed on the cooler 14 and the cap valve plug 92 supported in an open position to permit air-water exchange through the feed tube 16 in response to water dispensing from the reservoir, the weight of the bottle and the water contained therein is borne by the reservoir at the upper rim 30, and not by the adapter 10.

In the preferred form, the feed tube 16 is modified from the form shown in U.S. Pat. No. 5,413,152, to include a radially outwardly projecting baffle disk 95 (FIGS. 2–4) at the lower end of the inner tube 80. This baffle disk 95 functions to provide better separation between water flowing downwardly within the inner tube 80 from air exchanged upwardly from the reservoir and through the annular air pathway 86 to the bottle interior. More specifically, the baffle disk 95 requires the upward air flow to pass substantially horizontally at the upper surface of the disk 95 before turning vertically to pass through the air pathway 86, with the result that the air flow is better separated from the vertically downward water flow exiting the water flow path 84 at the lower end of the inner water tube 80. With this arrangement, any tendency of the upward air flow to entrain water into the air pathway 86 is reduced, and vice versa, to result in further improved overall rate of air-water exchange and a correspondingly improved overall flow rate of water flow downwardly into the reservoir 12.

Figure 7:
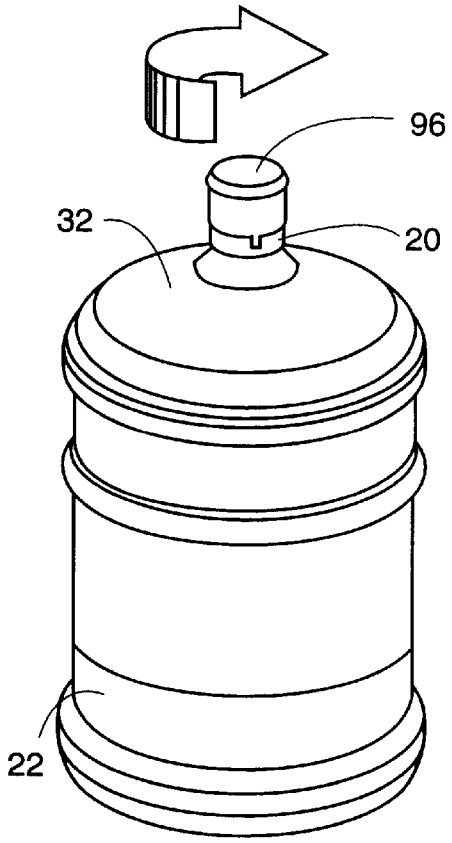
FIG. 7 is a perspective view depicting a conventional water bottle for mounting onto the bottled water cooler shown in FIG. 6, and illustrating the water bottle with a conventional tear-off bottle cap mounted thereon.

In one preferred form, the cap 18 is constructed in accordance with the resealable bottle cap shown and described in U.S. Pat. Nos. 5,232,125 or 5,392,939, both of which are incorporated by reference herein. Alternately, and in the most preferred form, the cap 18 is constructed according to U.S. Pat. No. 5,232,125, with the exception that the cap is designed for secure snap-fit mounting onto the bottle neck 20, and that a cap skirt 94 is significantly shortened in length (as viewed in FIGS. 8–10) to permit re-use of the cap 18 on a succession of water bottles. That is, water bottles may be supplied to the customer with a conventional non-valved bottle cap 96 with a tear-away skirt and related pull tab as viewed in FIG. 7, whereupon the conventional cap 96 is removed and discarded by the customer at the time the bottle is mounted onto a cooler and substituted by the re-usable cap 18. The re-usable cap comprises a cap body with the skirt 94 depending therefrom and having a size and shape and including an internal rib 97 (FIG. 10) for press-on snap-fit mounting onto the bottle neck 20. The water bottle 22 can then be inverted and installed onto the cooler 14 with the cap plug 92 carried by the cap body for operative engagement by the feed tube 16 to move the cap plug 92 to the open position. Subsequently, upon lift-off removal of the water bottle from the cooler, the re-usable cap 18 can be taken off the removed bottle and placed onto the next bottle to be installed onto the cooler.

An air filter unit 98 is also provided on the adapter 10. FIGS. 1, 3 and 5 show the air filter unit 98 mounted within a recessed pocket 100 formed in the landing 66, with an upper surface of the air filter unit 98 disposed a short distance below the landing 66. The air filter unit 98 comprises a shallow frame or housing 102 having a suitable porous air filter element 104 captured therein in a positioned generally centered over an air flow port 106 (FIG. 3) which opens downwardly through an aperture 108 in the pocket 100 into the underlying reservoir interior. A check valve 110 is desirably mounted within the port 106 to prevent upward water flow therethrough in the event of reservoir overfilling, such as might otherwise occur with use of a cracked bottle.

In accordance with a further aspect of the invention, the upper sleeve segment 50 of the adapter 10 includes at least one handle member in the form of a pair of diametrically opposed handles 112 each shown in the form of a relatively large radial opening disposed above the support landing 66. These handles 112 permit easy grasping of the adapter 10 from above for quick and easy press-fit installation of the adapter 10 into the upper end of a cooler reservoir 12, as described. Similarly, these handles 112 also permit quick and easy lift-out removal of the adapter from the reservoir, when and if desired. While these handles 112 are shown in the form of radial openings, it will be understood that an alternative handle geometry may include radially shaped recesses formed in the upper sleeve segment 50.

Figure 13:
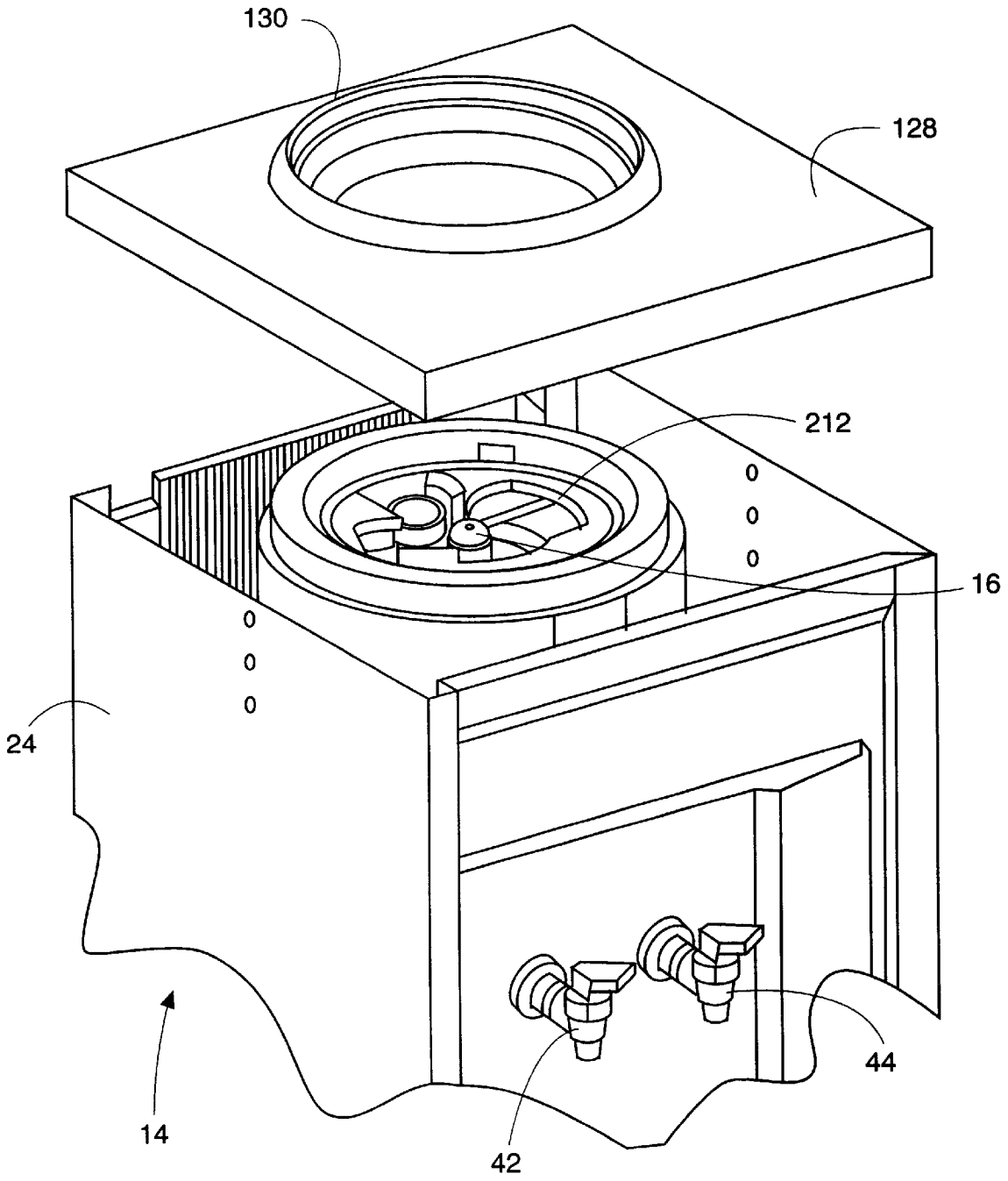
FIG. 13 is a top perspective view illustrating the mounting adapter of FIG. 11 installed onto a bottled water cooler, and depicting a removable cooler top in exploded relation therewith.
Figure 14:
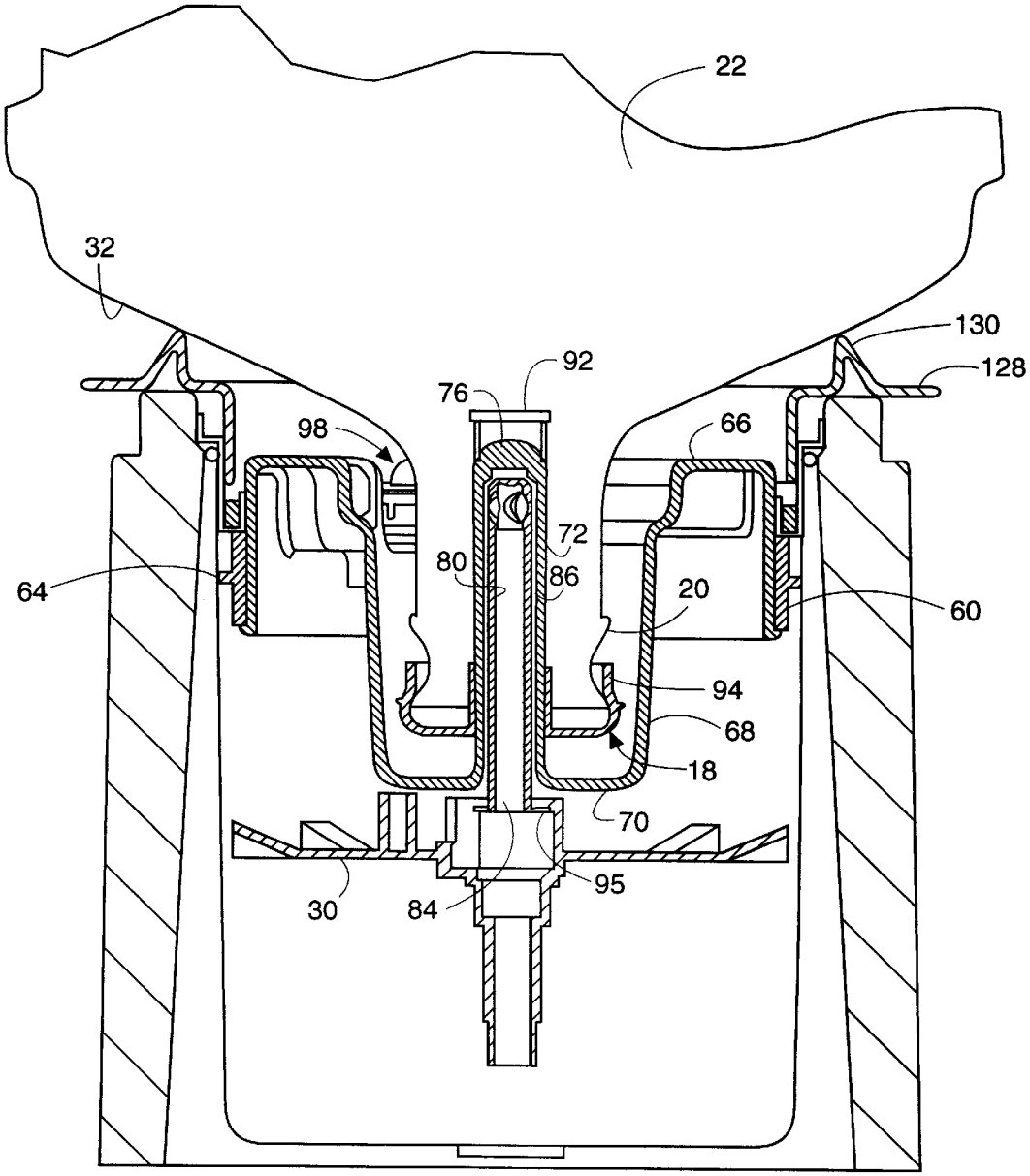
FIG. 14 is a fragmented vertical sectional view depicting the mounting adapter of FIG. 11 installed into the reservoir of the bottled water cooler of FIG. 13, with a water bottle mounted on the cooler in an inverted orientation.

FIGS. 11–14 show an alternative preferred form of the adapter, wherein the adapter has a substantially unitary plastic molded construction corresponding to that shown and described in FIGS. 1–6, with the exception that a modified upper sleeve segment 150 is carries a plurality of mounting clips 120 for vertically supporting the modified adapter from the upper end or marginal edge of a cooler reservoir 12 (as viewed in FIGS. 13–14). In this version, the mounting clips 120 are sized and shaped to vertically suspend the adapter within the reservoir. FIG. 13 shows a removably mounted housing top or lid 128 mounted over the installed adapter within the reservoir 12, wherein the lid 128 defines an upwardly projecting rim 130 to contact and support the sloping shoulder portion of a bottle mounted onto the cooler.

The modified adapter is shown with the upper sleeve segment 150 also defining radially open handles 212 to facilitate drop-in adapter installation and lift-out adapter removal. The remaining structural components of the modified adapter shown in FIGS. 11–14 correspond generally with the previously described embodiment of FIGS. 1–6, and are thus identified in the accompanying drawings by common reference numerals.

A variety of further modifications and improvements in and to the mounting adapter and related bottle cap of the present invention will be apparent to those persons skilled in the art. Accordingly, no limitation on the invention is intended by way of the foregoing description and accompanying drawings, except as set forth in the appended claims.

What is claimed is:

1. A mounting adapter for mounting on an upwardly open water reservoir of a bottled water cooler, said mounting adapter comprising:

an adapter body including an upstanding feed tube for engaging and opening a bottle cap carried on the neck of a water bottle;

a seal member carried by said adapter body for sealingly engaging an interior wall surface of the cooler reservoir upon slide-fit installation of said adapter body into the cooler reservoir;

at least one support member carried by said adapter body for vertically supporting and suspending said adapter body from the cooler reservoir when said adapter body is slide-fit installed therein; and at least one handle member formed by said adapter body and positioned for manual grasping from above to facilitate slide-fit installation and lift-out removal of said adapter body relative to the cooler reservoir, said at least one handle member defining a radially outwardly open handle port extending through said adapter body between said seal member and support member.

2. The mounting adapter of claim 1 wherein said mounting adapter comprises a unitary plastic molding.

3. The mounting adapter of claim 1 wherein said mounting adapter defines a radially outwardly open annular channel, and wherein said seal member comprises an annular seal ring seated within said channel.

4. The mounting adapter of claim 3 wherein said annular seal ring further includes a radially outwardly projecting annular seal lip for engaging the interior wall surface of the cooler reservoir.

5. The mounting adapter of claim 1 wherein said at least one support member comprises a radially outwardly projecting mounting flange formed at an upper end of said adapter body.

6. The mounting adapter of claim 1 wherein said at least one support member comprises a plurality of mounting clips carried by said adapter body.

7. The mounting adapter of claim 1 wherein said at least one handle member comprises a pair of handles formed on said adapter body generally adjacent an upper end thereof at diametrically opposed positions.

8. The mounting adapter of claim 1 wherein said at least one handle member comprises a pair of radially outwardly open handle ports formed in said adapter body.

9. The mounting adapter of claim 1 wherein said feed tube defines first and second flow paths for separate passage of air and water therethrough.

10. The mounting adapter of claim 1 further including an inner tube mounted within said feed tube and cooperating therewith to define first and second flow paths for separate passage of air and water therethrough.

11. The mounting adapter of claim 10 wherein said inner tube has a lower end terminating at least slightly below a lower end of said feed tube, said inner tube further including a radially outwardly projecting annular baffle disk formed at the lower end thereof.

12. The mounting adapter of claim 1 wherein said adapter body further defines an air inflow passage, and further including an air filter unit mounted along said air inflow passage.

13. The mounting adapter of claim 12 further including a check valve mounted along said air inflow passage for preventing water backflow therethrough.

14. The mounting adapter of claim 1 further comprising a bottle cap including a cap body carrying a valve plug for engagement by said feed tube to move said valve plug to an open position.

15. The mounting adapter of claim 14 wherein said bottle cap further includes a depending skirt on said cap body for snap-fit re-usable mounting of the bottle cap onto a succession of water bottles.

16. The mounting adapter of claim 1 wherein said adapter body includes an upper generally cylindrical sleeve segment carrying said seal member and said at least one support member, said sleeve segment having a lower margin merging with a radially inwardly extending and generally annular support landing, said support landing having a radially inner margin merging with a downwardly suspended and generally cup-shaped well, said well having a bottom wall with said feed tube upstanding therefrom.

17. The mounting adapter of claim 10 wherein said support landing has a recessed pocket formed therein, and further including an air filter unit mounted within said recessed pocket.

18. A mounting adapter for mounting on an upwardly open water reservoir of a bottled water cooler, said mounting adapter comprising:

an adapter body including an upper generally cylindrical sleeve segment having a lower margin merging with a radially inwardly extending and generally annular support landing, said support landing having a radially inner margin merging with a downwardly suspended and generally cup-shaped well having a bottom wall, and a feed tube projecting upwardly from said bottom wall for engaging and opening a bottle cap carried on the neck of a water bottle;

a seal member carried by said sleeve segment for sealingly engaging an interior wall surface of the cooler reservoir upon slide-fit installation of said adapter body into the cooler reservoir;

at least one support member carried by said sleeve segment for vertically supporting and suspending said adapter body from the cooler reservoir when said adapter body is slide-fit installed therein; and at least one handle member formed by said adapter body and positioned for manual grasping from above to facilitate slide-fit installation and lift-out removal of said adapter body relative to the cooler reservoir, said at least one handle member defining a radially outwardly open handle port extending through said sleeve segment extending through said adapter body between said seal member and support member.

19. The mounting adapter of claim 18 wherein said adapter body comprises a unitary plastic molding.

20. The mounting adapter of claim 18 wherein said sleeve segment defines a radially outwardly open annular channel, and wherein said seal member comprises an annular seal ring seated within said channel.

21. The mounting adapter of claim 20 wherein said annular seal ring further includes a radially outwardly projecting annular seal lip for engaging the interior wall surface of the cooler reservoir.

22. The mounting adapter of claim 18 wherein said at least one support member comprises a radially outwardly projecting mounting flange formed at an upper end of said sleeve segment.

23. The mounting adapter of claim 18 wherein said at least one support member comprises a plurality of mounting clips carried by said sleeve segment.

24. The mounting adapter of claim 18 wherein said at least one handle member comprises a pair of handles formed on said sleeve segment generally adjacent an upper end thereof at diametrically opposed positions.

25. The mounting adapter of claim 18 wherein said at least one handle member comprises a pair of radially outwardly open handle ports formed in said sleeve segment.

26. The mounting adapter of claim 18 further including an inner tube mounted within said feed tube and cooperating therewith to define first and second flow paths for separate passage of air and water therethrough, said inner tube having a lower end terminating at least slightly below a lower end of said feed tube, said inner tube further including a radially outwardly projecting annular baffle disk formed at the lower end thereof.

27. The mounting adapter of claim 18 wherein said adapter body further defines an air inflow passage, and further including an air filter unit mounted along said air inflow passage.

28. The mounting adapter of claim 27 further including a check valve mounted along said air inflow passage for preventing water backflow therethrough.

29. The mounting adapter of claim 18 wherein said support landing has a recessed pocket formed therein, and further including an air filter unit mounted within said recessed pocket.

30. A mounting adapter for mounting on an upwardly open water reservoir of a bottled water cooler, said mounting adapter comprising:

an adapter body including an upstanding feed tube for engaging and opening a bottle cap carried on the neck of a water bottle;

a seal member carried by said adapter body for sealingly engaging an interior wall surface of the cooler reservoir upon installation of said adapter body into the cooler reservoir;

at least one support member carried by said adapter body for vertically supporting and suspending said adapter body with respect to the cooler reservoir when said adapter body is installed therein; and an inner tube mounted within said feed tube and cooperating therewith to define first and second flow paths for separate passage of air and water therethrough, said inner tube having a lower end terminating at least slightly below a lower end of said feed tube, said inner tube further including a radially outwardly projecting annular baffle disk formed at the lower end thereof.

31. The mounting adapter of claim 30 further including at least one handle member formed by said adapter body and positioned for manual grasping from above to facilitate installation and removal of said adapter body relative to the cooler reservoir.

32. The mounting adapter of claim 31 wherein said at least one handle member comprises a pair of handles formed on said adapter body generally adjacent an upper end thereof at diametrically opposed positions.

33. The mounting adapter of claim 30 further comprising a bottle cap including a cap body carrying a valve plug for engagement by said feed tube to move said valve plug to an open position, and a depending skirt on said cap body for snap-fit re-usable mounting of the bottle cap onto a succession of water bottles.

34. The mounting adapter of claim 30 wherein said adapter body includes an upper generally cylindrical sleeve segment carrying said seal member and said at least one support member, said sleeve segment having a lower margin merging with a radially inwardly extending and generally annular support landing, said support landing having a radially inner margin merging with a downwardly suspended and generally cup-shaped well, said well having a bottom wall with said feed tube upstanding therefrom.

35. The mounting adapter of claim 34 wherein said support landing has a recessed pocket formed therein, and further including an air filter unit mounted within said recessed pocket.

* * * * *